US010490924B2

(12) United States Patent
Matsuoka

(10) Patent No.: US 10,490,924 B2
(45) Date of Patent: Nov. 26, 2019

(54) ELECTRICAL CONNECTION STRUCTURE INCLUDING TUNING FORK-SHAPED TERMINAL

(71) Applicant: AISIN SEIKI KABUSHIKI KAISHA, Kariya-shi, Aichi-ken (JP)

(72) Inventor: Naoya Matsuoka, Kariya (JP)

(73) Assignee: AISIN SEIKI KABUSHIKI KAISHA, Kariya-shi, Aichi-ken (JP)

( * ) Notice: Subject to any disclaimer, the term of this patent is extended or adjusted under 35 U.S.C. 154(b) by 0 days.

(21) Appl. No.: 16/166,652

(22) Filed: Oct. 22, 2018

(65) Prior Publication Data

US 2019/0123466 A1 Apr. 25, 2019

(30) Foreign Application Priority Data

Oct. 23, 2017 (JP) ..... 2017-204399

(51) Int. Cl.
*H01R 13/11* (2006.01)
*H01R 9/24* (2006.01)
(Continued)

(52) U.S. Cl.
CPC ..... *H01R 13/112* (2013.01); *H01R 9/2458* (2013.01); *H01R 12/58* (2013.01);
(Continued)

(58) Field of Classification Search
CPC ..... H01R 13/52; H01R 13/112; H01R 13/11; H01R 13/58; H01R 4/48; H01R 4/52
(Continued)

(56) References Cited

U.S. PATENT DOCUMENTS 3,545,080 A * 12/1970 Evans ..... H01R 13/052 24/618
4,030,792 A * 6/1977 Fuerst ..... H01R 12/585 439/629
(Continued)

FOREIGN PATENT DOCUMENTS

JP 2003-250213 A 9/2003
JP 2005-65343 A 3/2005
(Continued)

OTHER PUBLICATIONS

Extended European Search Report dated Feb. 25, 2019 issued by the European Patent Office in counterpart European application No. 18201895.2.

*Primary Examiner* — Tulsidas C Patel
*Assistant Examiner* — Peter G Leigh
(74) *Attorney, Agent, or Firm* — Sughrue Mion, PLLC

(57) ABSTRACT

An electrical connection structure includes: a tuning fork-shaped terminal having a slit-shaped space formed at an end portion; a first support that supports the tuning fork-shaped terminal; a plate-shaped terminal having a conduction region formed at an end portion; and a second support that supports the plate-shaped terminal, in which the electrical connection structure has a structure in which the conduction region of the plate-shaped terminal is fitted into the slit-shaped space of the tuning fork-shaped terminal by connecting the first support and the second support, and thereby the tuning fork-shaped terminal and the plate-shaped terminal reach an electrical conduction state, and the plate-shaped terminal includes a thin flexible portion that allows deformation due to bending in a plate thickness direction.

5 Claims, 5 Drawing Sheets

(51) Int. Cl.
*H01R 12/58* (2011.01)
*H01R 13/05* (2006.01)

(52) U.S. Cl.
CPC ..... *H01R 13/055* (2013.01); *H01R 13/113* (2013.01); *H01R 2201/26* (2013.01)

(58) Field of Classification Search
USPC ..... 439/76.2; 29/874
See application file for complete search history.

(56) References Cited

U.S. PATENT DOCUMENTS 5,004,426 A * 4/1991 Barnett ..... H01R 12/585 439/82
5,073,132 A * 12/1991 Nottrott ..... H01R 13/055 29/863
5,147,218 A * 9/1992 Matthews ..... H01R 4/2429 439/404
5,273,442 A * 12/1993 Laub ..... H05K 7/1023 439/526
5,681,192 A * 10/1997 Kobayashi ..... H01R 13/055 439/884
5,957,734 A * 9/1999 Gladd ..... H01R 13/11 439/857
6,062,916 A * 5/2000 Gladd ..... H01R 9/223 439/751
6,077,131 A * 6/2000 Fukuda ..... H01R 13/04 439/884
6,099,338 A * 8/2000 Huang ..... H01R 13/627 439/350
6,254,440 B1 * 7/2001 Ko ..... H01R 13/112 439/857
6,375,521 B2 * 4/2002 Tachi ..... H01R 13/04 439/877
6,406,338 B1 * 6/2002 Endo ..... H01R 13/055 29/874
6,488,550 B1 * 12/2002 Kikuchi ..... H01R 13/112 439/857
6,846,206 B2 * 1/2005 Kling ..... H01R 13/055 439/849
6,997,727 B1 * 2/2006 Legrady ..... H01R 12/57 439/246
7,001,188 B2 * 2/2006 Kobayashi ..... H01R 9/2458 439/76.2
7,080,999 B2 * 7/2006 Narui ..... H01R 13/6315 439/246
7,090,547 B2 * 8/2006 Machida ..... H01R 13/04 439/825
7,201,584 B1 * 4/2007 Ju ..... H01R 13/2407 439/66
7,261,568 B2 * 8/2007 Ju ..... H01R 13/2435 439/342
7,283,366 B2 * 10/2007 Yamashita ..... B60R 16/0238 165/80.1
8,979,602 B2 * 3/2015 Cappe ..... H01R 13/04 439/884
9,172,169 B2 * 10/2015 Hagio ..... H01R 13/113
9,219,325 B2 * 12/2015 Endo ..... H01R 12/73
9,276,342 B2 * 3/2016 Masubuchi ..... H01R 12/775
2003/0017757 A1 * 1/2003 Murakami ..... H01R 13/04 439/884
2005/0227552 A1 * 10/2005 Yamashita ..... H01R 9/2466 439/862
2008/0188112 A1 * 8/2008 Ju ..... H01R 13/28 439/342
2014/0141631 A1 5/2014 Wang et al.

FOREIGN PATENT DOCUMENTS

JP 2005-295638 A 10/2005
JP 2016-110733 A 6/2016

* cited by examiner

ELECTRICAL CONNECTION STRUCTURE INCLUDING TUNING FORK-SHAPED TERMINAL

CROSS REFERENCE TO RELATED APPLICATIONS

This application is based on and claims priority under 35 U.S.C. § 119 to Japanese Patent Application 2017-204399, filed on Oct. 23, 2017, the entire contents of which are incorporated herein by reference.

TECHNICAL FIELD

This disclosure relates to an electrical connection structure that reaches an electrically conductive state by fitting a plate-shaped terminal into a slit-shaped space of a tuning fork-shaped terminal.

BACKGROUND DISCUSSION

As an electrical connection structure having the above-described configuration, JP 2003-250213 A (Reference 1) discloses a technique in which a tuning fork-shaped terminal (a connection terminal 39d in Reference 1) and a slackened deformed portion (34a) are displaced even in a case where a plate-shaped terminal (legs 11a in Reference 1) and the tuning fork-shaped terminal are deviated when being connected to each other by forming the deformed portion at a terminal connecting portion continuing to the tuning fork-shaped terminal, thereby maintaining a contact state.

In Reference 1, a distal end of the tuning fork-shaped terminal (connection terminal 39d) branches into a forked shape, and the forked shape is brought into a conductive state by interposing the plate-shaped terminal (the leg 11a) at a surface that the portion of the forked shape faces. In addition, in a case where tuning fork-shaped terminal is allowed to be displaced by deforming the deformed portion (34a), and the tuning fork-shaped terminal and the plate-shaped terminal are connected in an inappropriate posture, automatic adjustment is performed to bring each of the tuning fork-shaped terminal and the plate-shaped terminal in an appropriate posture by deforming the deformed portion.

In this type of electrical connection structure, a support member for supporting a tuning fork-shaped terminal and a support member for supporting a plate-shaped terminal can be fitted together by a linear sliding operation, and in a state in which two support members are fitted together, the tuning fork-shaped terminal and the plate-shaped terminal are designed to be appropriately fit together. That is, after fitting of the two support members, the respective positional relationship is set such that the plate-shaped terminal is interposed between a pair of contact conduction portions which have a forked shape at the tuning fork-shaped terminal with equal pressure.

However, due to distortion of errors and postures at the time of manufacturing the tuning fork-shaped terminal and the plate-shaped terminal, it was considered that the plate-shaped terminal was not appropriately fitted into a slit-like fitting space of the tuning fork-shaped terminal even in a state where the two support members were fitted together. Specifically, a strong force acted on one of the pair of the contact conduction portions having the forked shape at the tuning fork-shaped terminal from the plate-shaped terminal, and thereby the distance between the contact conduction portions having the forked shape was enlarged and the plate-shaped terminal did not come into contact with the other contact conduction portion.

Such a disadvantage is improved to some extent by providing the deformed portion as in Reference 1. However, it is difficult to eliminate a situation in which an external force acts to enlarge the distance between the pair of the contact conduction portions having the forked shape. Note that, in a configuration having the deformed portion as disclosed in Reference 1, since a deformable member is connected to the tuning fork-shaped terminal, the number of parts is increased and a structure becomes complicated, and thus improvement for these is required.

Thus, a need exists for an electrical connection structure which is not susceptible to the drawback mentioned above.

SUMMARY

A feature of an electrical connection structure according to an aspect of this disclosure resides in that the electrical connection structure includes a tuning fork-shaped terminal having a slit-shaped space formed at an end portion; a first support that supports the tuning fork-shaped terminal; a plate-shaped terminal having a conduction region formed at an end portion; and a second support that supports the plate-shaped terminal, in which the electrical connection structure has a structure in which the conduction region of the plate-shaped terminal is fitted into the slit-shaped space of the tuning fork-shaped terminal by connecting the first support and the second support, and thereby the tuning fork-shaped terminal and the plate-shaped terminal reach an electrical conduction state, and the plate-shaped terminal includes a thinned flexible portion that allows deformation due to bending in a plate thickness direction.

The flexible portion is thinned—that is made to be thin—relative to a proximal end of the plate-shaped terminal. In some embodiments, the flexible portion may also be thinned relative to the conduction region of the plate-shaped terminal.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Embodiments disclosed here will be described below with reference to the drawings.

Basic Configuration

Figure 1:
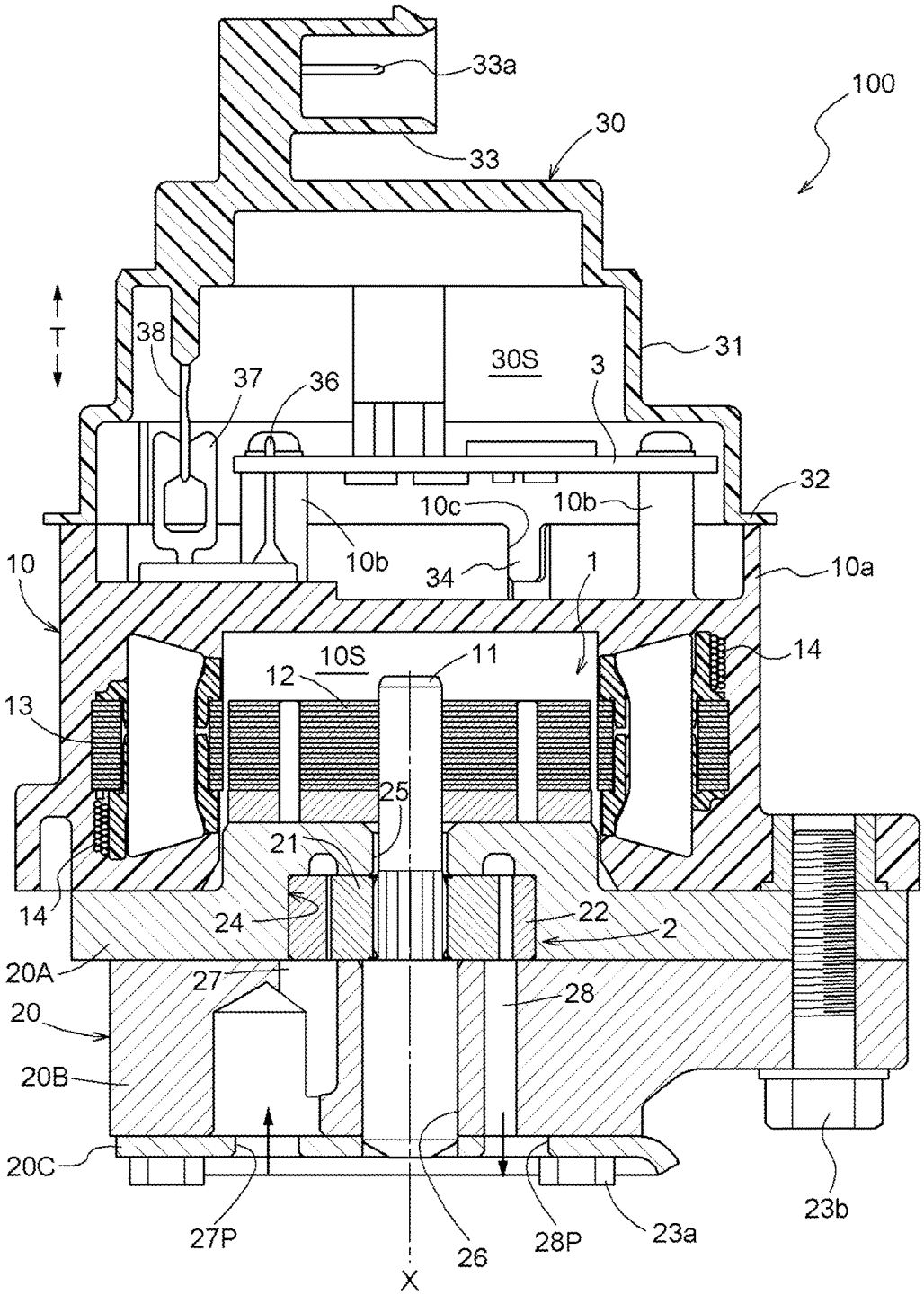
FIG. 1 is a sectional view of an oil pump.

As illustrated in FIG. 1, an oil pump 100 is constituted by connecting a motor housing 10 (an example of a first support), a pump housing 20, and a control housing 30 (an example of a second support).

This oil pump 100 is provided in, for example, a hybrid type vehicle or a vehicle in which idle stop control is performed, and enables supply of hydraulic pressure to a transmission in a situation where an engine (not shown) stops.

As illustrated in FIG. 1, the oil pump 100 houses an electric motor 1 in a resin motor housing 10, houses a pump portion 2 in a metal pump housing 20, and houses a control substrate 3 in a resin control housing 30. That is, the oil pump 100 has a structure in which the pump housing 20, the motor housing 10, and the control housing 30 are stacked in this order.

In this oil pump 100, a drive shaft 11 driven and rotated by a driving force of the electric motor 1 is disposed in a region extending from the motor housing 10 to the pump housing 20, and the pump portion 2 is driven by the driving force of the drive shaft 11.

The pump housing 20 is provided with a suction port 27P and a discharge port 28P. By driving the pump portion 2 with the driving force of the electric motor 1, oil is sucked from the suction port 27P and oil is discharged from the discharge port 28P.

For example, the oil pump 100 is provided in the vehicle in such a manner that a part of the control housing 30 is supported by a shift control case of the vehicle.

Motor Portion, Pump Portion, and Drive Shaft

As illustrated in FIG. 1, the electric motor 1 includes a drive shaft 11 rotatably supported coaxially with a driving axis X, a motor rotor 12 fixed to one shaft end of the drive shaft 11, and a stator 13 disposed in a region surrounding the motor rotor 12.

The motor rotor 12 includes a back yoke and a plurality of permanent magnets, and is disposed in a motor space 10S. A coil 14 is wound around a stator core constituting the stator 13 and is inserted into the motor housing 10. Although this electric motor 1 is configured as a three-phase brushless DC motor, it may be configured as an induction motor or a three-phase motor.

Figure 2:
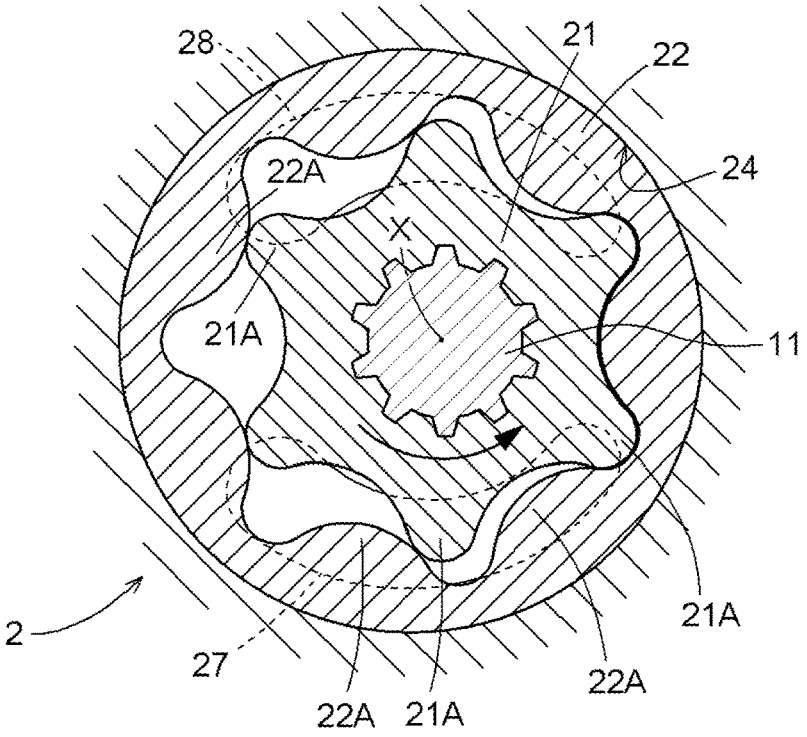
FIG. 2 is a sectional view of a pump portion.

As illustrated in FIG. 1 and FIG. 2, the pump portion 2 is configured by housing an inner rotor 21 driven by the drive shaft 11 and an outer rotor 22 as a pump rotor in a pump space 24. The pump portion 2 is configured in an internal gear type in which a part of an external tooth portion 21A of the inner rotor 21 and an internal tooth portion 22A of the outer rotor 22 mesh with each other.

As illustrated in FIG. 1, the pump housing 20 is configured by stacking a first housing 20A in which the pump space 24 is formed, a second housing 20B connected to the first housing 20A, and a plate 20C connected to the outer surface side of the second housing 20B, and these are connected to each other by a connecting bolt 23*a*. Further, the pump housing 20 thus connected is fastened to the motor housing 10 by a fastening bolt 23*b*.

A pump space 24 is formed in the first housing 20A, and a first insertion hole portion 25 having a through hole shape into which the drive shaft 11 of the drive shaft 11 is inserted is formed. A second insertion hole portion 26 functioning as a bearing hole portion is formed in the second housing 20B. A suction flow path 27 communicating with the negative pressure side of the pump space 24 and a discharge flow path 28 communicating with the high pressure side of the pump space 24 are formed in the second housing 20B.

In a plate 20C, the suction port 27P in the form of a through hole is formed at a position communicating with the suction flow path 27, and a discharge port 28P in the form of a through hole is formed at a position communicating with the discharge flow path 28.

In the oil pump 100, as illustrated in FIG. 2, the inner rotor 21 rotates integrally with the drive shaft 11 as the electric motor 1 rotates. In conjunction with this rotation of the outer rotor 22, the negative pressure acts on the suction flow path 27, oil is sucked from the suction port 27P to the suction flow path 27, and the oil pressurized by the pump portion 2 is discharged from the discharge flow path 28 to the discharge port 28P.

Control Housing

As illustrated in FIG. 1, the control housing 30 is formed in a casing shape to be joined to a joining end portion of the motor housing 10 on the opposite side to the pump housing 20 by a technique of welding or the like, and the control substrate 3 described above is housed in an inner space 30S of the control housing 30. Note that, the inner space 30S is a space including not only a space inside the control housing 30 but also a recessed portion formed at the end portion of the motor housing 10.

The control housing 30 is formed with a bulging portion 31 which bulges in a direction away from the motor housing 10. A flange portion 32 is integrally formed on the proximal end side (the lower side in FIG. 1) of the bulging portion 31, and a connector portion 33 is integrally formed with a projecting portion (the upper end portion in FIG. 1) in the direction in which the bulging portion 31 bulges.

Figure 3:
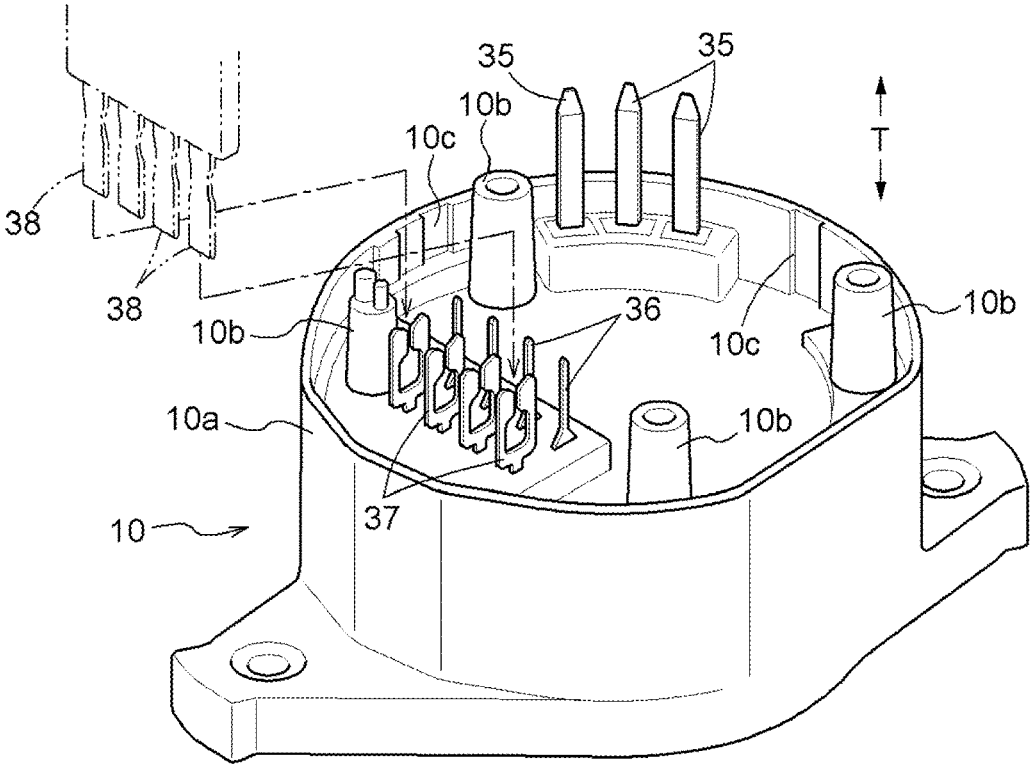
FIG. 3 is a perspective view of a motor housing.

As illustrated in FIG. 1 and FIG. 3, a cylindrical wall portion 10*a* is integrally formed along the outer periphery of the motor housing 10 at a portion of the motor housing 10 on the opposite side to the control housing 30. The flange portion 32 is joined to the end face of the cylindrical wall portion 10*a* by thermal fusion bonding. An adhesive may be used as a bonding form, and bonding may be performed by fastening a screw or the like.

In the region surrounded by the cylindrical wall portion 10*a*, a plurality (four in this embodiment) of substrate support portions 10*b* are formed to protrude from the motor housing 10, and the control substrate 3 is fixed to three of the four substrate support portions 10*b* by screws. A positioning protrusion of the control substrate 3 is formed on the remaining one of the substrate support portions 10*b*. A groove-shaped engagement recessed portion 10*c* is formed at a plurality of positions on the inner periphery of the cylindrical wall portion 10*a*, and an engagement protrusion 34 engageable with the engagement recessed portion 10*c* is formed in the control housing 30.

With such an engagement configuration provided, the motor housing 10 (an example of the first support) and the control housing 30 (an example of the second support) are relatively moved in the proximity direction along the movement direction T (the direction parallel with the driving axis X) as illustrated in FIG. 3, and therefore, the corresponding engagement protrusion 34 are brought into engagement with a plurality of engagement protrusions 34, so that the motor housing 10 and the control housing 30 have an appropriate positional relationship.

As illustrated in FIG. 3, three coil terminals 35 conducted to the coil 14 are formed so as to protrude from the motor housing 10. Further, in the inner space 30S, in a form supported by the motor housing 10, the plurality (four in the embodiment) of conducting shaft bodies 36 and the plurality (four in the embodiment) tuning fork-shaped terminals 37 are supported by the motor housing 10 in a positional relationship of being arranged in parallel.

Note that, the conducting shaft body 36 and the tuning fork-shaped terminal 37 are integrally formed by pressing a good conductor such as a copper alloy. Also, it is also possible to use a steel plate for the tuning fork-shaped terminal 37. A pair of contact conduction portions 37*b* of the tuning fork-shaped terminal 37 is subjected to a surface treatment for performing gold plating, tin plating or the like (refer to FIG. 4).

In the control substrate 3, printed wiring is formed on the front surface, and control elements conducted to these are mounted. Three through holes into which the three coil terminals 35 are inserted and four through holes into which the four conducting shaft bodies 36 are inserted are formed on the control substrate 3. With this configuration, three coil terminals 35 and four conducting shaft bodies 36 are connected by solder in a state where the control substrate 3 is supported by the substrate support portion 10*b* while being inserted into the through holes.

Four connector terminals 33*a* are provided inside the connector portion 33, and four conduction terminals 38 (an example of plate-shaped terminals) individually conducted to the connection terminals 33*a* are provided inside the control housing 30. These are specific configurations of the electrical connection structure that reaches the electrically conductive state, and the conduction terminal 38 is made of a good conductor such as a copper alloy as described above, and is fit into a slit-shaped space 37S of the tuning fork-shaped terminal 37 to which a conduction region 38S at the end position of the conduction terminal 38 corresponds. With this, the tuning fork-shaped terminal 37 and the conduction terminal 38 reach a conductive state.

Figure 4:
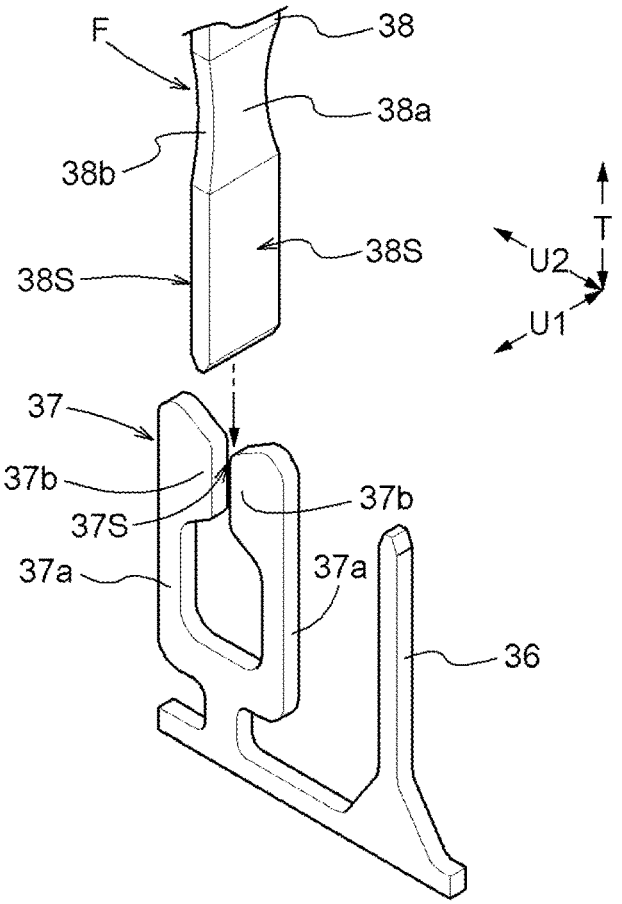
FIG. 4 is a perspective view of a tuning fork-shaped terminal and a conduction terminal.

With the electrical connection structure provided, when connecting the pump housing 20 to the motor housing 10, in a state where the above-described engagement protrusion 34 is engaged with the engagement recessed portion 10*c*, four conduction terminal 38 are fitted into corresponding tuning-fork shaped terminals 37 by an operation of bringing them close to each other along the movement direction T as illustrated in FIG. 4.

Since the four conducting shaft bodies 36 to which each of the four tuning fork-shaped terminals 37 are conducted are conducted to the printed wiring of the control substrate 3, the electric power supplied from the connector portion 33 is supplied to the three coil terminals 35 via the control substrate 3 to realize control of the electric motor 1.

Electrical Connection Structure

Figure 5:
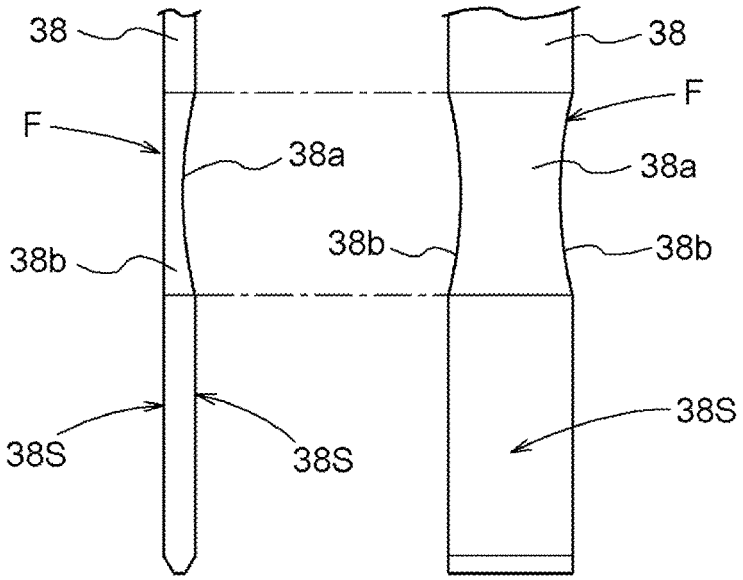
FIG. 5 is a view illustrating a side surface shape and a top surface shape of the conduction terminal.

As illustrated in FIG. 3 to FIG. 5, the tuning-fork-shaped terminal 37 has an arm-shaped portion 37*a* having a forked shape, and has a contact conduction portion 37*b* protruding in the proximity direction at a distal end portion of each arm-shaped portion 37*a*. In addition, the slit-shaped space 37S is formed between the pair of the contact conduction portions 37*b*, and a region of the conduction terminal 38 which is interposed (fitted) by the pair of contact conduction portions 37*b* corresponds to the conduction region 38S. By chamfering a corner portion of the protruding end of the conduction region 38S, the arm-shaped portion 37*a* is easily fit into the contact conduction portion 37*b*.

The tuning fork-shaped terminal 37 is supported in a position fixed state with respect to the motor housing 10 as a first support and the conduction terminal 38 is supported in a position fixed state with respect to the control housing 30 as a second support.

Accordingly, in a case where the positional relationship between the tuning fork-shaped terminal 37 and the conduction terminal 38 is not appropriate due to a manufacturing error or the like, it is conceived that the tuning fork-shaped terminal 37 and the conduction terminal 38 do not fit appropriately when the motor housing 10 and the control housing 30 are brought close to each other along the movement direction T in a state where the engagement protrusion 34 is engaged with the engagement recessed portion 10*c*.

Here, as illustrated in FIG. 4, the width direction (plate thickness direction of the tuning fork-shaped terminal 37) of the conduction terminal 38 is referred to as a first direction U1, the thickness direction of the conduction terminal 38 (width direction of the tuning fork-shaped terminal 37) is referred to as a second direction U2, and the positional relationship at the time of fitting the conduction terminal 38 and the tuning fork-shaped terminal 37 will be described. Note that, the first direction U1, the second direction U2, and the movement direction T are orthogonal to each other.

That is, even if the conduction terminal 38 and the tuning fork-shaped terminal 37 are slightly shifted in the first direction U1 relative to each other based on the proper positional relationship, a position of the conduction terminal 38 fitted to a pair of contact conduction portions 37*b* of the tuning fork-shaped terminal 37 is displaced along the first direction U1 (in a direction orthogonal to the plate surface of the tuning fork shaped terminal 37), which does not cause inconvenience in fitting.

However, in a case where the conduction terminal 38 and the tuning fork-shaped terminal 37 are slightly shifted in the second direction U2 based on the proper positional relationship, when the conduction terminal 38 is fitted to the tuning fork-shaped terminal 37, the conduction terminal 38 strongly contacts one of the pair of contact conduction portions 37*b* of the terminal 37. This contact expands the space between the arm-shaped portions 37*a* and leads to an inappropriate conducting state where only one of the contact conduction portions 37*b* contacts the conduction terminal 38.

In order to solve this inconvenience, a thin-walled flexible portion F that allows deformation in a form in which the conduction terminal 38 is bent is formed on the proximal end side (the upper side in FIG. 4) from the conduction region 38S. As illustrated in the left side of FIG. 4 and FIG. 5, the flexible portion F has a recessed portion 38*a* having a cross-sectional shape of a circular arc shape or an arc shape as viewed in a direction along the first direction U1, and in the right side of FIG. 5, the flexible portion F has a pair of narrow portions 38*b* narrowing the portion corresponding to the area where the recessed portion 38*a* is formed as viewed in a direction along the second direction U2.

Figure 6:
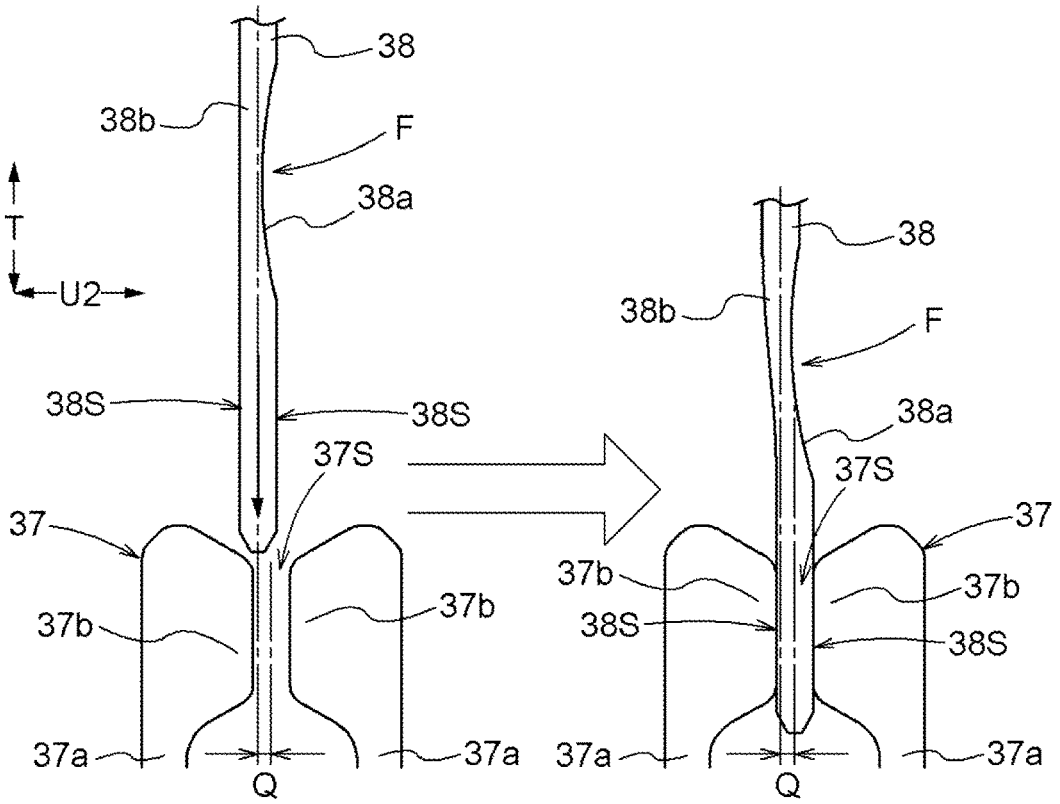
FIG. 6 is a view illustrating a state before and after conduction between the tuning fork-shaped terminal and the conduction terminal.

Due to this structure, as illustrated in FIG. 6, in the connecting operation in a state where a center line in the thickness direction of the conduction terminal 38 is offset by an offset amount Q based one the center lines of the pair of contact conduction portions 37*b* of the tuning fork-shaped terminal 37 (a state where positional relationship shifted in the direction of the second direction U2), the connection is allowed in a state where the conduction terminal 38 is deformed by bending of the flexible portion F.

That is, in this connection operation, when motor housing 10 (first support) and the control housing 30 (second support) are brought close to each other along the movement direction T so as to be connected to each other, as illustrated in the left side of FIG. 6, the conduction region 38S of the conduction terminal 38 (plate-shaped terminal) is inserted into the slit-shaped space 37S of the tuning fork-shaped terminal 37. In this inserted state, when the motor housing 10 and the control housing 30 are brought further closer to each other, a force acts between the tuning fork-shaped terminal 37 and the conduction terminal 38, and due to the action of this force, the conduction terminal 38 is deformed in the flexible portion F by bending as illustrated in the right side of FIG. 6.

In the right side of FIG. 6, a state where the tuning fork-shaped terminal 37 and the conduction terminal 38 reach a connection position is illustrated, and as illustrated in FIG. 6, as the conduction terminal 38 is bent in the flexible portion F, the phenomenon that the conduction terminal 38 strongly contacts only one of the pair of contact conduction portions 37*b* is suppressed while the center in the thickness direction at a base end portion of the conduction terminal 38 is offset from the center of the pair of contact conduction portions 37*b* of the tuning fork-shaped terminal 37, so that there is no enlargement of the space between the pair of arm-shaped portions 37*a*, and an excellent conduction state in which the conduction region 38S of the conduction terminal 38 is equally interposed by the inner surfaces of the pair of contact conduction portions 37*b* is realized.

In this configuration, since the recessed portion 38*a* has a cross section having a circular arc shape or an arc shape, in the case where the conduction terminal 38 is bent in the flexible portion F, smooth deformation is realized without locally concentrating the stress. In addition, with the pair of narrow portions 38*b* formed, it is possible to make excellent deformation without reducing the thickness of the thin portion of the flexible portion F to a small value.

The flexible portion F is formed on the proximal end side from the position in contact with the conduction terminal 38 with respect to the contact conduction portion 37*b*, and thus, for example, as compared with a portion in which a part of the flexible portion F overlaps the contact conduction portion 37*b*, it is possible to lead the deformation of the flexible portion F to an excellent conduction state.

Figure 7:
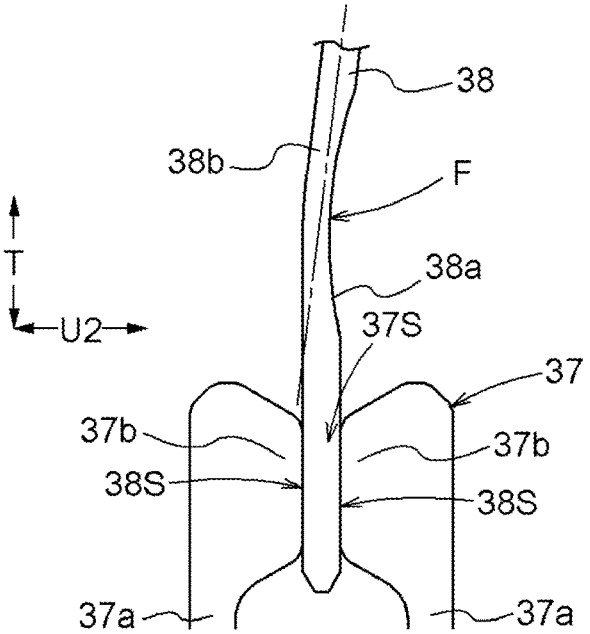
FIG. 7 is a view illustrating bending of a flexible portion.

Further, it is also supposed that the center line tilts in the thickness direction of the conduction terminal 38 with respect to the center line of the pair of contact conduction portions 37*b* of the tuning fork-shaped terminal 37. In such a case, in a state where the tuning fork-shaped terminal 37 and the conduction terminal 38 reach the connection position, as illustrated in FIG. 7, the conduction terminal 38 is bent so as to be curved in the flexible portion F, thereby an excellent conduction state in which the conduction region 38S of the conduction terminal 38 is equally interposed by the inner surfaces of the pair of contact conduction portions 37*b* is realized.

Other Embodiments

The present invention may be configured in the following manner besides the above-described embodiments (those having the same functions as those in the embodiment are denoted by the same reference numerals as in the embodiments).

Figure 8:
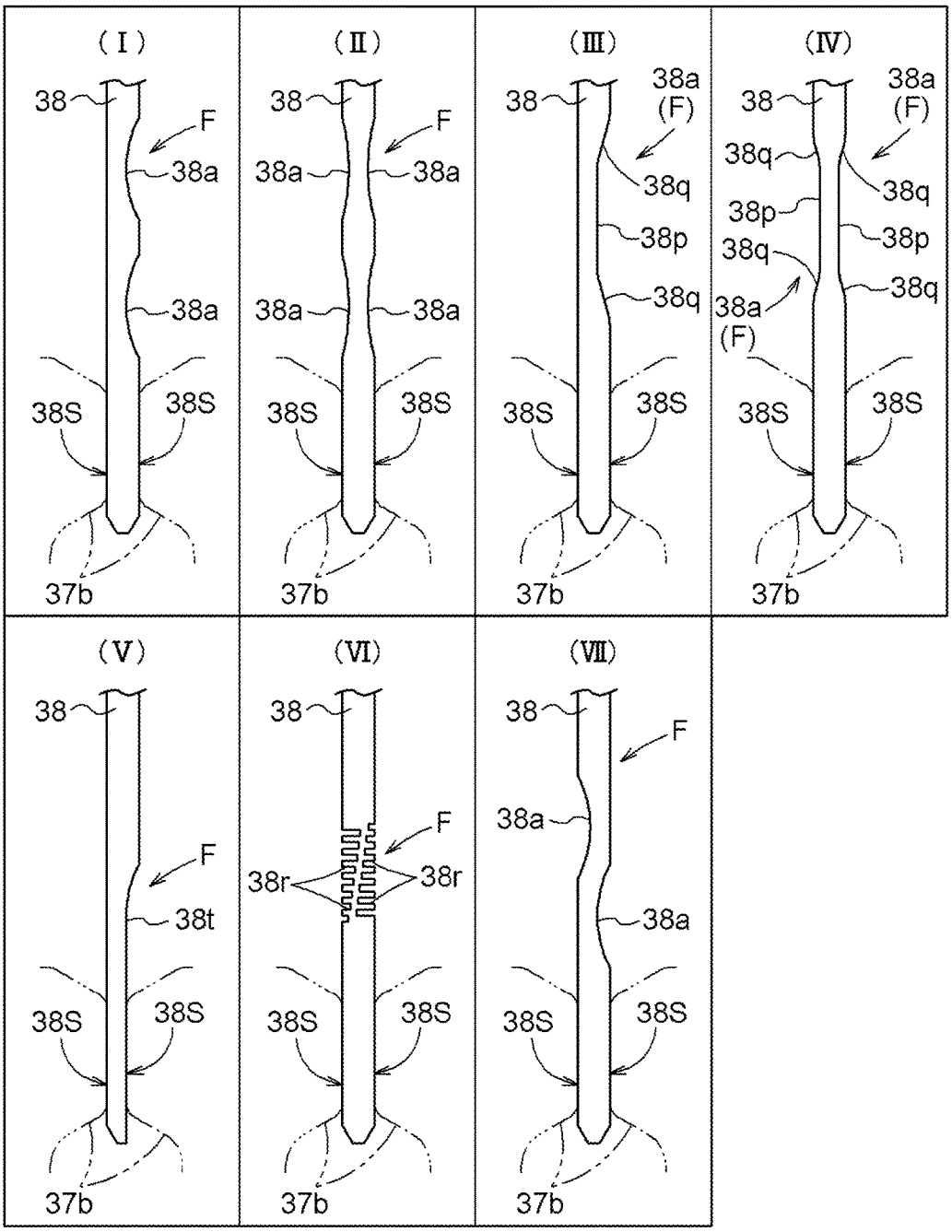
FIG. 8 is a view illustrating other embodiments in a list.

(a) As illustrated in column I of FIG. 8, similar to the embodiment, a plurality of the recessed portions 38*a* which are thin in the plate thickness direction and whose cross-sectional shape is that of an arc, in particular a circular arc are continuously arranged on one surface of the conduction terminal 38 (two in embodiment a) in the extension direction of the conduction terminal 38 so as to form the flexible portion F. This configuration enables excellent bending without reducing the thickness of the flexible portion F. In this embodiment (a), the flexible portion F can be configured to include three or more recessed portions 38*a*, and the flexible portion F may be configured to be narrow.

(b) As illustrated in column II in FIG. 8, similar to the embodiment, a plurality of the recessed portions 38*a* whose cross-sectional shape is that of an arc, in particular a circular arc are arranged at a position where both surfaces of the conduction terminal 38 overlap with each other in the plate thickness direction so as to form the flexible portion F. In this embodiment (b), two pairs of recessed portions 38*a* overlapping with each other in the plate thickness direction are arranged in the extension direction of the conduction terminal 38. This configuration enables excellent bending. In this embodiment (b), the flexible portion F may be configured to be narrow. Further, the number of the recessed portions 38*a* may be one.

(c) As illustrated in column III of FIG. 8, as the flexible portion F, a single recessed portion 38*a* including a flat bottom surface portion 38*p* that is parallel to the plate surface of the conduction terminal 38 and a pair of side surface portions 39*q* continuous with the bottom surface portion 38*p* is configured. With such a cross-sectional shape, for example, it is possible to adjust the length of the bottom surface portion 38*p* in the projecting direction of the conduction terminal 38 while maintaining the thickness of the conduction terminal 38 of the bottom surface portion 38*p* at a constant value. In this embodiment (c), the flexible portion F may be configured to be narrow. Further, a plurality of sets of the recessed portion 38*a* may be provided.

(d) As illustrated in column IV of FIG. 8, the recessed portion 38*a* of embodiment (c) is disposed on both sides of the conduction terminal 38 so as to form the flexible portion F. In this embodiment (d), the pair of recessed portions 38*a* are arranged at positions where the recessed portions 38*a* overlap with each other, but may be arranged to deviate somewhat in the projecting direction. From the configuration of this embodiment (d), bending is performed in a form in which the bottom surface portion 38*p* is curved on average. In this embodiment (d), the flexible portion F may be configured to be narrow. Further, a plurality of sets of the recessed portion 38*a* may be provided.

(e) As illustrated in column V of FIG. 8, the flexible portion F is formed in the conduction terminal 38 by setting the thickness of a distal end portion smaller than the base end portion of the conduction terminal 38. In this embodiment (e), a thin wall portion 38T which is thinned by cutting or pressing is formed on one surface of the conduction terminal 38. A central region of the conduction terminal 38 in this thin portion 38T is the flexible portion F, and the conduction region 38S is formed on both surfaces of the distal end portion. In the configuration of this embodiment (e), it is possible to bend in a region where the projecting direction of the conduction terminal 38 is long. In this embodiment (e), the flexible portion F may be configured to be narrow.

(f) As illustrated in column VI of FIG. 8, a plurality of groove portions 38*r* are formed on at least one surface in the thickness direction of the conduction terminal 38 to cover the entire width of the conduction terminal 38 so as to form the flexible portion F. In this embodiment (f), a plurality of groove portions 38*r* having different groove depths are formed on both surfaces of the conduction terminal 38, and the bending of the conduction terminal 38 at each of the plurality of groove portions 38*r* can make the bending enlarged overall. In this embodiment (f), the flexible portion F may be configured to be narrow.

(g) As illustrated in column VII of FIG. 8, similar to the embodiment, the flexible portion F is constituted by arranging the recessed portions 38*a* whose cross-sectional shape is that of an arc, in particular a circular arc at positions shifted from each other in the extension direction of the conduction terminal 38 on both surfaces of the conduction terminal 38.

This configuration enables excellent bending without reducing the thickness of the flexible portion F. In the configuration of this embodiment (g), the flexible portion F can be configured to include three or more recessed portions 38*a*. In this embodiment (g), the flexible portion F may be configured to be narrow.

(h) Instead of an electrical connection structure that is in a conductive state inside the housing as in the embodiment, for example, the tuning fork-shaped terminal 37 is supported on one of a pair of fitting members configured so as to be fitted and separated, and the conduction terminal 38 is provided on the other side, thereby constituting a connector. In this configuration, one of the pair of fitting members is a first support 10 and the other is a second support 30. In addition, this is applied to the electrical connection structure other than the electrical connection structure described in the embodiment.

The present invention can be used for an electrical connection structure that reaches a conductive state by fitting a plate-shaped terminal in a slit-shaped space of a tuning fork-shaped terminal.

A feature of an electrical connection structure according to an aspect of this disclosure resides in that the electrical connection structure includes a tuning fork-shaped terminal having a slit-shaped space formed at an end portion; a first support that supports the tuning fork-shaped terminal; a plate-shaped terminal having a conduction region formed at an end portion; and a second support that supports the plate-shaped terminal, in which the electrical connection structure has a structure in which the conduction region of the plate-shaped terminal is fitted into the slit-shaped space of the tuning fork-shaped terminal by connecting the first support and the second support, and thereby the tuning fork-shaped terminal and the plate-shaped terminal reach an electrical conduction state, and the plate-shaped terminal includes a thinned flexible portion that allows deformation due to bending in a plate thickness direction. The flexible portion is thinned—that is made to be thin—relative to a proximal end of the plate-shaped terminal. In some embodiments, the flexible portion may also be thinned relative to the conduction region of the plate-shaped terminal.

According to the above configuration, in a case where even one of the tuning fork-shaped terminal and the plate-shaped terminal is in a positional relationship out of an appropriate position, when the first support and the second support are shifted to a connected state, the plate-shaped terminal is strongly brought into contact with one of a pair of inner surfaces constituting the slit-shaped space of the tuning fork-shaped terminal in accordance with an operation of fitting the plate-shaped terminal into the slit-shaped space of the tuning fork-shaped terminal. Since a stress acts on the flexible portion of the plate-shaped terminal at the time of this contact, the plate-shaped terminal is deformed in a form of being bent in the flexible portion, and it is possible to maintain a contact state, in which the pair of inner surfaces equally interpose the plate-shaped terminal therebetween, without increasing the distance between the pair of inner surfaces constituting the slit-shaped space.

As a result, it is possible to provide an electrical connection structure capable of fitting the tuning fork-shaped terminal and the plate-shaped terminal together in an appropriate posture.

As another configuration, the flexible portion may be formed as a recessed portion having a cross-sectional shape which is an arc shape at a center portion in an extension direction of the plate-shaped terminal.

According to this configuration, in a case where the flexible portion is deformed, since the center portion of the recessed portion is deformed largest, and the deformation amount becomes smaller as the portion is separated from the center portion, the deformation is made in a form of being generally curved, and thereby it is possible to prevent the plate-shaped terminal from being damaged by suppressing local deformation. Further, it is considered that the recessed portion having the arc cross-sectional shape may have a smoothly dented shape, and some errors are allowable, and thus the recessed portion can be easily manufactured by press working or the like.

As another configuration, the flexible portion may be formed as a recessed portion having a cross-sectional shape which is a circular arc shape at a center portion in an extension direction of the plate-shaped terminal.

According to this configuration, in a case where the flexible portion is deformed, since the center portion of the recessed portion is deformed largest, and the deformation amount becomes smaller as the portion is separated from the center portion, the deformation is made in a form of being generally curved, and thereby it is possible to prevent the plate-shaped terminal from being damaged by suppressing local deformation. In addition, since the cross-sectional shape of the flexible portion is the circular arc shape, there is no inconvenience that a thin portion of the flexible portion is made extremely thin.

As another configuration, the tuning fork-shaped terminal has a pair of contact conduction portions interposing the conduction region of the plate-shaped terminal fitted into the slit-shaped space, in which the flexible portion may be disposed on the proximal end side of the plate-shaped terminal with respect to a contact position at which the conduction region of the plate-shaped terminal contacts the contact conduction portion.

According to this configuration, in a state in which the conduction region of the plate-shaped terminal is fitted into the slit-shaped space of the tuning fork-shaped terminal, the flexible portion is formed on the proximal end side from the position in contact with the conduction terminal portion with respect to the contact conduction portion among the plate-shaped terminals, and thus, for example, as compared with a portion in which a part of the flexible portion overlaps the contact conduction portion, it is possible to lead the deformation of the flexible portion to excellent conduction.

As another configuration, the flexible portion may have a reduced width in a width direction of the plate-shaped terminal. The flexible portion is narrowed—made to have a reduced width or to be narrow—relative to the proximal end of the plate-shaped terminal. In some embodiments, the flexible portion may also be narrowed relative to the conduction region of the plate-shaped terminal.

According to this configuration, in addition to thinning the thickness of a portion of the flexible portion in the thickness direction among the plate-shaped terminals, the width direction at the portion of the flexible portion is set to be narrow, and thus deformation due to the bending of the flexible portion in the thickness direction can be more easily performed.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An electrical connection structure, comprising:

a tuning fork-shaped terminal having a slit-shaped space formed at an end portion;

a first support that supports the tuning fork-shaped terminal;

a control substrate disposed in the first support;

a plate-shaped terminal having a conduction region formed at an end portion; and a second support that supports the plate-shaped terminal, tuning fork-shaped terminal has a proximal end fixed to the first support, a first extension portion extending from the proximal end toward the control substrate and connected to the control substrate, and a second extension portion extending from the proximal end in the same direction as the extension direction of the first extension portion and engaging with the plate-shaped terminal, and wherein the electrical connection structure has a structure in which the conduction region of the plate-shaped terminal is fitted into the slit-shaped space of the tuning fork-shaped terminal by connecting the first support and the second support, and thereby the tuning fork-shaped terminal and the plate-shaped terminal reach an electrical conduction state, and the plate-shaped terminal includes a thinned flexible portion that allows deformation due to bending in a plate thickness direction.

2. The electrical connection structure according to claim 1, wherein the flexible portion is formed as a recessed portion having a cross-sectional shape which is an arc shape at a center portion in an extension direction of the plate-shaped terminal.

3. The electrical connection structure according to claim 1, wherein the flexible portion is formed as a recessed portion having a cross-sectional shape which is a circular arc shape at a center portion in an extension direction of the plate-shaped terminal.

4. The electrical connection structure according to claim 1, wherein the tuning fork-shaped terminal has a pair of contact conduction portions interposing the conduction region of the plate-shaped terminal fitted into the slit-shaped space, and the flexible portion is disposed on a proximal end side of the plate-shaped terminal with respect to a contact position at which the conduction region of the plate-shaped terminal contacts the contact conduction portion.

5. The electrical connection structure according to claim 1, wherein the flexible portion has a reduced width in a width direction of the plate-shaped terminal.

* * * * *